United States Patent [19]

Anderson

[11] Patent Number: 4,504,274

[45] Date of Patent: Mar. 12, 1985

[54] ENRICHMENT OF LOW GRADE COALS

[75] Inventor: Ardis L. Anderson, Ponca City, Okla.

[73] Assignee: Conoco Inc., Ponca City, Okla.

[21] Appl. No.: 534,958

[22] Filed: Sep. 22, 1983

[51] Int. Cl.[3] ..... C10L 9/08; C10L 9/10

[52] U.S. Cl. ..... 44/6; 44/1 F; 34/9

[58] Field of Search ..... 44/1 F, 1 G, 6; 34/9, 34/13

[56] References Cited

U.S. PATENT DOCUMENTS

| | | | |
|---|---|---|---|
| 3,520,067 | 7/1970 | Winegartner | 34/9 |
| 3,754,876 | 8/1973 | Pennington et al. | 44/1 F |
| 3,985,517 | 10/1976 | Johnson | 44/1 G |
| 4,280,876 | 7/1981 | Green | 34/10 X |
| 4,324,562 | 4/1982 | Schoppe | 44/1 G |
| 4,401,436 | 8/1983 | Bonnecaze | 44/1 G |

*Primary Examiner*—Carl F. Dees

*Attorney, Agent, or Firm*—Cortlan R. Schupbach

[57] ABSTRACT

High moisture coal is dried in a turbulent bed by contact with heated char. The dried coal is cooled and then treated with a coal spray for storage stability against spontaneous combustion.

6 Claims, 1 Drawing Figure

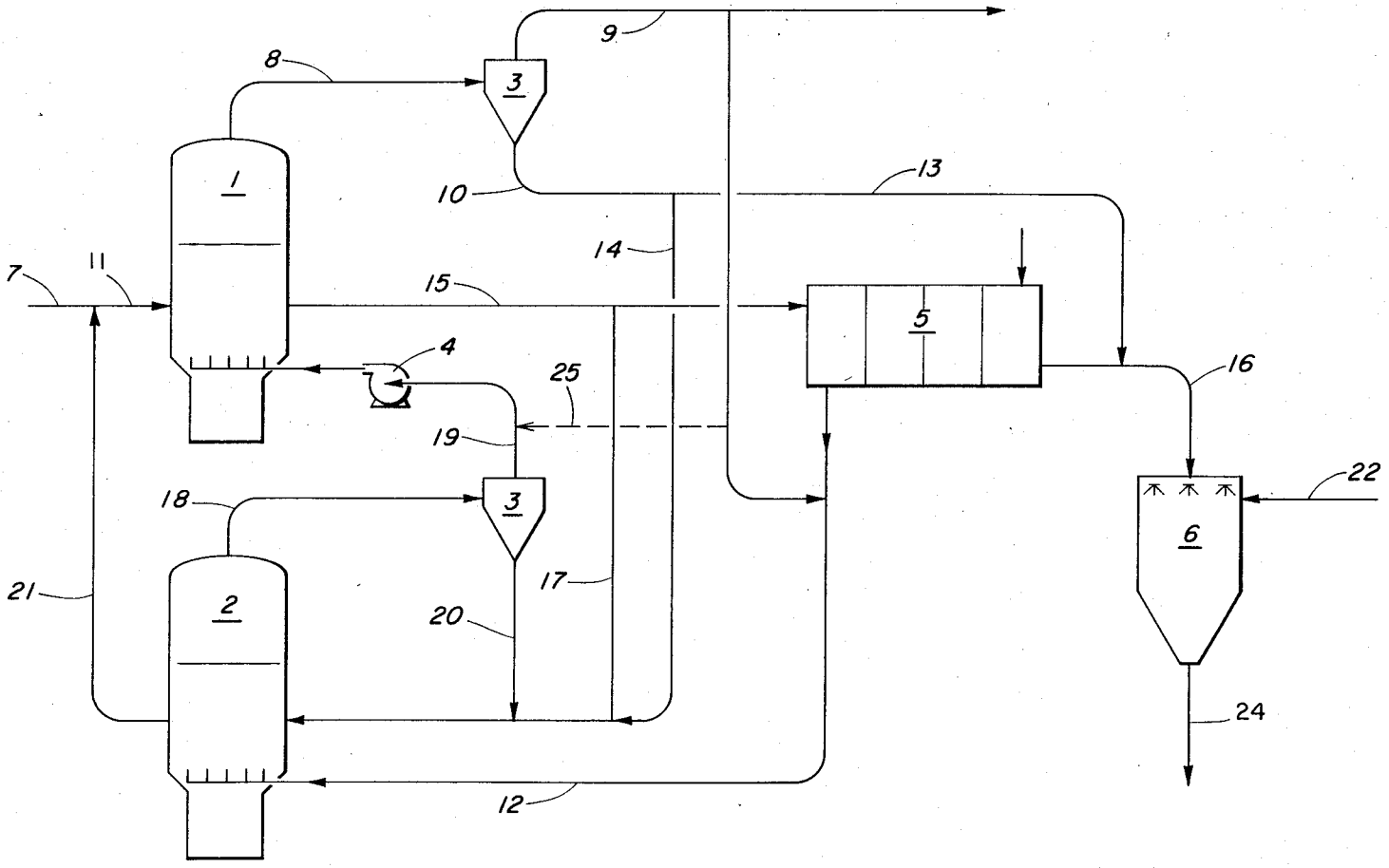
22
16
24
6
5
13
9
14
25
17
12
3
3
10
15
4
19
20
8
1
2
18
11
7
21

ENRICHMENT OF LOW GRADE COALS

This invention pertains to a process to enrich or upgrade low rank coals such as lignite or sub-bituminous coal. More specifically, this invention deals with a process for upgrading such low rank coals by drying the fuel in a turbulent bed unit and subsequently treating the dried fuel to greatly reduce spontaneous combustion propensities.

The United States has large sub-bituminous reserves in the Rocky Mountain area and large lignite deposits in North Dakota and Texas, these deposits comprising the largest lignite coal deposits in the United States and possibly in the world. Such deposits are estimated to contain over 550 billion recoverable tons of coal. Both the sub-bituminous and lignite coals generally contain very low sulfur levels, making such coals desirable fuels from the standpoint of air pollution. However, such coals also tend to be high in moisture and therefore have very low heating values. Such coals usually contain from about 30 to about 40% water as obtained from the coal mines.

A large number of utility companies currently transport sub-bituminous coals from the Rocky Mountain area of the United States to the mid-western section of the country because of air pollution requirements and the low sulfur amounts of such coals. In many cases, power stations utilizing such fuels are de-rated to a considerable degree since the fuel used contains such a high moisture content. These units were originally designed for higher heating value midwest or eastern coal and much financial loss is suffered due to "de-rating" and the enormous sums spent for transportation, much of this being provided to move water as contained in the coal.

Numerous types of equipment and various techniques for drying such coals are available and have been in use for some time. In general, hot combustion gases are used to drive moisture from coal, accomplished either by passing such gases through a bed of the coal (either moving or fluidized bed) or by passing the coal through a kiln or other rotary device while the gases are passed through. In commercial use the combustion gases are usually obtained from coal or fuel oil and the fuel/air ratio is maintained so that the combustion gases contain about 5% by volume of oxygen.

There is a great deal of prior art showing the desirability of drying high moisture coal. Representative but non-exhaustive of such prior art references include U.S. Pat. No. 4,213,752, which discloses a single step process for drying lignite including solid-solid heat transfer. This process utilizes a single process vessel which receives wet lignite while partially combusting the lignite to provide heat for drying. U.S. Pat. No. 3,985,516 dries lignite with hot gas and then stabilizes such material with an oil spray. U.S. Pat. No. 2,844,886 mixes wet coal with heated coal in a fluid bed to dry the wet coal but uses an inefficient process. U.S. Pat. No. 4,280,876 shows heating coal by contact with hot particulate solids utilizing solid-solid contact.

Further, one of the characteristics of dried coal is a tendency toward spontaneous combustion. This tendency becomes a serious problem during the shipment and storage of such coal. Coal subjected to drying in the presence of oxygen is somewhat improved in its spontaneous combustion characteristics. It is greatly desired that such dried coals be stabilized in order to prevent such spontaneous combustion from occurring.

It is therefore desirable to provide an improved process for upgrading or enriching low rank coal such as lignite or sub-bituminous coals by drying such materials in an economical fashion. Further, a method of preventing such dried fuels from spontaneously combusting is also desirable.

It is therefore an object of the present invention to provide an improved process for enriching or upgrading low rank coal by drying such materials in a turbulent bed unit, preferably the dried fuel has been oil treated to reduce its propensity to spontaneously combust.

I have now discovered that low grade coals can be enriched utilizing a process comprising (a) grinding said coal to a particle size no greater than about ½ inch in diameter;

(b) contacting the coal of (a) with hot coal char having a temperature of from about 600° F. to about 1200° F. to form an intimate mixture thereof and passing said mixture into a turbulent drying means to provide an exiting coal stream and an off gas/fines stream;

(c) separating the coal exiting said dryer means into two portions (1) a first portion passing through a heat exchanger to cool said stream, and provide heated air and product coal and (2) a second portion passing into a turbulent burner zone, wherein said portion is partially combusted with heated air from (1) to form (i) hot char having a temperature of from about 600° F. to about 1000° F., (ii) off gases which are recycled to (b) and (iii) fines which are sent to separation;

(d) separating the off gases and fines of (2), the off gases utilized to further dry the low grade coal and the fines recycled for further combustion;

(e) separating the off gas/fine stream of (d) into flue gas and fines, wherein the fines are added to the product coal stream.

It is preferred in the process as described, when stream (c) is separated into two portions, that the portions be unequal in size and that the first smaller portion passes through a heat exchanger to cool said stream and the second larger portion passes into a turbulent burner zone. Normally the relative size of each portion such diverse streams will range from about 1 part to about 3 part by weight respectively, but from about 1 part to about 2 part by weight is preferred.

In addition, the instant process provides a means for aiding the combustion by obtaining the off gas and fines from the drying process and utilizing such materials as a partial replacement for fuel grade coal.

The coal drying process of the present invention is readily carried out in an apparatus which is a moving fluidized bed to which the wet coal is fed. Normally a fluidized bed dryer is operated with fluidizing gas made by blending air and optionally recycled off gas from a combustion step.

The solid-solid heat transfer of the present invention is very effective, requiring equipment containing fewer units or are much smaller in size than those of the prior art. As a comparative example, FMC Corporation, in a paper presented at the Coal Technology meeting, Houston, Tex., Nov. 18–20, 1980 stated that "Five Million tons of mine sub-bituminous coal per year required 22 drying units, each 11 feet 6 inches in diameter by 54 inches long, and 3 cooling units 15 feet wide by 20 feet long would adequately handle the material. However, the same tonage of mined coal can be upgraded utilizing a turbulent bed drier of approximately 1000 square feet in area. Burners of about equal size can accommodate the char which is burned. Such turbulent bed units are inexpensive as compared to the prior art.

BRIEF DESCRIPTION OF THE DRAWING

The drawing of the present invention describes in general the process for enrichment of low grade coals.

DETAILED DESCRIPTION OF THE DRAWING

The drawing discloses an improved process enriching low grade coal. In the process coal ground to about ½ inch in size or less is passed into a drying unit (1) through line (11). Immediately prior to entering the dryer, raw coal is contacted with hot char coal and the combined stream (11) is fed to the dryer. The hot char coal is obtained from burner unit (2) before contact in line (7). The hot char coal and the raw coal are intimately contacted and drying is rapid.

Coal dried in unit (1) exits a gas/fines stream through line (8) which is passed into a separating means (3). The separating means divides the stream into a flue gas stream (9) and fines stream (10). The flue gas stream (9) is vented or preferably recycled to aid the combustion in the combustor by providing the needed turbulence through line (12). Fines stream (10) is divided into two portions, one portion recovered as product coal (13), and a second portion (14) which is utilized to support combustion in combustor (2).

Dried coal exiting the turbulent bed drier (1) through line (15) is divided into two portions, one portion of which enters a shallow fluid bed heat exchanger (5) for cooling, such material then exiting the heat exchanger through line (16) where it is combined with any fines (13) from the dryer overhead. The remaining portion is passed (17) to the burner and utilized as feed material for making hot charcoal for drying incoming raw coal.

A turbulent bed burner (2) maintains a partial combustion of coal entering from lines (14) and (17) as well as overhead flue gases and fines from the turbulent bed combustor (2). Overhead from such turbulent bed combustor exits through line (18) and is separated by a separating means (3) such as a cyclone vessel. The overhead from such separation consists of hot gases (19) which pass via blower (4) into turbulent dryer (1).

Bottoms from such separation pass through line (20) and are combined with lines (14) and (17) to promote combustion in the turbulent bed burner (2).

The drawing also shows a preferred embodiment wherein product coal (16) is passed into a spray chamber for a coal oil treating (6) and dried. Treated coal exits (24) as product coal. The coal treating oil is passed into drying unit (6) through line (22).

Hot char exits the turbulent bed burner (2) via line (21), which line is combined with incoming raw coal (7), preferably at a temperature of from about 300° F. to about 700° F., depending upon the moisture which must be removed from the raw coal. However, normally such materials would have a temperature of from about 350° to about 500° F. Flue gas from the burner unit (2) is directed to the dryer to provide bed turbulence and any additional heat energy which is obtained from the burner. If additional gas is needed to provide adequate turbulence, flue gas from cyclone (3) passing through line (9) can be directed to the combustor and ultimately the dryer, or it can be directed to the dryer through by-passing the combustor via line (25). Such gases are not cooled normally, unless needed to adjust drying rates in the dryer.

Dried coal exiting dryer (1) is split into two streams (15) and (17). One stream (17) is directed to the turbulent bed burner where a limited combustion takes place to provide the hot char coal. The remainder of the hot coal (15) normally the larger stream is sent to the fluid exchanger (5) to be cooled. The gases utilized to cool the product coal are normally obtained from air and may be combined with the flue gas from the dryer unit (1) to preheat the air prior to entering the combustion chamber (2).

In an optional but preferred embodiment the cool dry coal is then sent to a spray chamber where the coal is spray oiled with a coal treating oil. Such coal treating oils when used at a rate of about 1 to 5 gallons per ton, preferably about 3 to 4 gallons per ton efficiently atomized will, in effect, encapsulate the particles rendering them essentially oxidation resistant. This operation tends to prevent the spontaneous combustion problem.

Gas leaving the dryer via line (8) contains some coal dust and therefore is sent to a separation vessel such as a cyclone vessel. Fines are sent either to the spray chamber for oiling or to the burner for combustion or a combination of these. Flue gases can be utilized to help preheat air (12) for combustion.

Notice should be taken that acceptable coal spray oil compositions are utilized in the art. Preferred compositions include those described in U.S. Pat. No. 4,201,657 hereby incorporated by reference into the present invention. In general, such coal oil spray compositions comprise from 50 to 75 volume percent decanted oil from a fluidized bed catalytic cracking operation, said decant oil having a k-factor of not more than 10.5; and 50 to 25 volume percent asphalt, said composition having an initial boiling point above 500° F., a viscosity of at least 700 centistokes at 100° F. and a flash point of at least 230° F.

The present invention is useful on coal being ground to a size of ½ inch or less, but ¼ inch or less is preferred for more rapid drying. It is realized that the smaller the size, the more rapid the drying. However, the present invention is useful for larger size coal in constrast to the prior art and allows such coals to be dried efficiently in a rapid manner using inexpensive equipment and utilizing separate chambers for heating and drying. The use of separate chambers provide fine control and additional separation of fines, hot gases and the like for maximum efficiency of the drying process.

The invention is more concretely described with reference to the example below wherein all parts and percentages are by weight unless otherwise specified. The example is provided to illustrate the present invention and not to limit it.

EXAMPLE

In a typical drying test, a Wyodak subbituminous coal containing 30 weight percent moisture is first crushed to a ¼ inch maximum size. For each part by weight of raw coal feed, about 2 parts of hot char at about 1000° F. are contacted with the raw feed just prior to entering the dryer. An equilibrium temperature of about 350° F. is attained in the unit. Most of the heat energy needed to dry the coal is supplied by the hot char. A significant portion, however, is derived from the hot gas entering the bottom of the dryer. A residence time of about 10 minutes is required.

The product leaving the dryer is essentially moisture-free and is split into two streams. The portion exiting as product consists of about 0.65 part based on the feed. The quantity not recovered (about 0.35 parts) consists of 0.30 part water which leaves the drier as overhead via (8) and about 0.05 part solids which is mainly ash and exits with the drier product via line (15). The other portion of the dryer exit stream directed to the combustor consists of about 2.05 parts by weight of dried coal and char. Of this stream about 0.05 part is combusted and 2 parts are recycled to the dryer. The char is heated from about 350° F. back up to about 1000° F.

The reaction rate can be controlled either by varying the ratio of air to recycle gas to the combustor or by an oxygen content increase of the gaseous material entering the combustor zone apparatus. In this fashion, combustion rate is kept at optimum and production of hot char coal and the proper temperature thereof is controlled. It is an important feature of the present invention that very fine control of the process can be obtained utilizing the separate vessels. The present invention likewise provides a high throughput rate in drying very wet coal.

In combination with the coal oil treating method of the present invention, coals can be dried to very low levels without fear of spontaneous combustion. Cost of a oil treating a ton of coal at about 4 gallons per ton will range from about 3 to 4 dollars, which is very inexpensive when compared to the relative cost of transportion of the additional weight of water. The process of the present invention provides very low moisture coals with low capital investment, efficient enrichment thereof, and with the optional spray drying provides protection against spontaneous combustion.

While certain embodiments and details have been shown for the purpose of illustrating this invention, it will be apparent to those skilled in this art that various changes and modifications may be made herein without departing from the spirit or scope of the invention.

I claim:

1. A process for enrichment of low grade coal comprising (a) grinding said coal to a particle size no greater than about ½ inch in diameter;

(b) contacting the coal of (a) with hot coal char having a temperature of from about 600° F. to about 1200° F. to form an intimate mixture thereof and passing said mixture into a turbulent drying means to provide an exiting coal stream and an off gas/-fines stream;

(c) separating the coal exiting said dryer means . into two portions (1) a first portion passing through a heat exchanger to cool said stream and provide heated air and product coal and (2) a second portion passing into a turbulent burner zone, wherein said portion is partially combusted with heated air from (1) to form (i) hot char having a temperature of from about 600° F. to about 1000° F., (ii) off gases which are recycled to (b) and (iii) fines which are sent to separation;

(d) separating the off gases and fines of (2), the off gases utilized to further dry the low grade coal and the fines recycled for further combustion;

(e) separating the off gas/fine stream of (d) into flue gas and fines, wherein the fines are added to the product coal stream.

2. A process as described in claim 1 wherein the separation of (c) is into unequal portions, the larger portion passing through (1) and the smaller portion passing through (2).

3. A process as described in claim 2 wherein the particle size is no greater than about ¼ inch in diameter.

4. A process as described in claim 3 wherein a portion of the flue gas of (e) is added to the heated air of (1) to enhance combustion.

5. A process as described in claim 4 wherein the product coal stream is treated with a coal spray oil at a rate of about 1 to about 5 gallons per ton to encapsulate coal particles.

6. A process as described in claim 5 wherein the coal spray comprises a hydrocarbon composition containing from 50 to 75 volume percent decanted oil from a fluidized bed catalytic cracking operation, said decant oil having a k-factor of not more than 10.5; and 50 to 25 volume percent asphalt, said composition having an initial boiling point above 500° F., a viscosity of at least 700 centistokes at 100° F. and a flash point of at least 230° F.

* * * * *